US012653295B1

(12) United States Patent
Neugent

(10) Patent No.: US 12,653,295 B1
(45) Date of Patent: Jun. 16, 2026

(54) FLUID DISPENSER

(71) Applicant: Sabrina S. Neugent, Midlothian, TX (US)

(72) Inventor: Sabrina S. Neugent, Midlothian, TX (US)

( * ) Notice: Subject to any disclaimer, the term of this patent is extended or adjusted under 35 U.S.C. 154(b) by 0 days.

(21) Appl. No.: 18/827,768

(22) Filed: Sep. 8, 2024

Related U.S. Application Data

(63) Continuation-in-part of application No. 18/235,387, filed on Aug. 18, 2023, now Pat. No. 12,108,862.

(51) Int. Cl.
*A45D 34/04* (2006.01)
*B65D 47/20* (2006.01)

(52) U.S. Cl.
CPC ..... *A45D 34/04* (2013.01); *B65D 47/20* (2013.01); *A45D 2200/05* (2013.01)

(58) Field of Classification Search
CPC .... A45D 34/04; A45D 2200/05; A45D 34/02; A45D 40/262; B65D 47/20; B65D 47/2006; B65D 47/2031
USPC .... 401/183–186, 262–266; 383/50, 55, 906; 206/229
See application file for complete search history.

(56) References Cited

U.S. PATENT DOCUMENTS 2,569,073 A * 9/1951 Robinson ..... B65D 47/2031 401/152
3,292,644 A * 12/1966 Ericson ..... A46B 11/0041 401/132
5,746,532 A * 5/1998 Megill ..... A46B 11/0027 401/175
5,911,532 A * 6/1999 Evancic ..... A46B 11/002 401/281
7,108,442 B2 * 9/2006 DuFour ..... B65D 47/44 401/266

* cited by examiner

*Primary Examiner* — David J Walczak
(74) *Attorney, Agent, or Firm* — Jeffrey Roddy

(57) ABSTRACT

A fluid dispenser article includes an exterior, a fluid reservoir, a foldable applicator portion which may include an applicator tip with a dispensing aperture, a movable flap which covers the applicator tip, and a conduit between the reservoir and the applicator tip such that fluid may flow up to an end of the dispensing aperture when the reservoir is squeezed. In some implementations a resealable closure such as a sliding closure may be formed over or atop the dispensing aperture.

3 Claims, 9 Drawing Sheets

FLUID DISPENSER

This application is a Continuation-in-Part of U.S. application Ser. No. 18/235,387 having a filing date of Aug. 18, 2023 and entitled "Fluid Dispenser."

FIELD OF THE INVENTION

The invention relates to fluid dispensers and particularly cosmetic applicators.

BACKGROUND

Lipsticks and lip gloss typically are provided by cosmetic manufacturers in stick (solid) or liquid form (bottled) with a separate applicator, typically a brush, whether foam or bristle. As quality cosmetics can be expensive, collecting any more than a trivial number of shades may be cost prohibitive. Additionally, conventional lipstick packaging often requires special storage considerations, e.g., upright storage and in a cool dark location. Furthermore, containers of lipstick may separate over time or become contaminated; e.g., with bacteria or fungal contamination.

Accordingly, it would be desirable to provide consumers with a special container having a small convenient amount of lipstick so that they may collect and try a variety of shades without committing to a large quantity of product. It would be further desirable if the special container included a material applicator portion suitable for various contents, e.g., lipstick, lotion, cologne, integrated with the container. It would be even further desirable if the special container were resealable.

It would also be desirable if such a container with the foregoing advantages, were readily suited to dispense small samples of materials of differing viscosities.

SUMMARY

In a general example implementation of the present invention, a fluid dispenser includes a container with a fold-away applicator tip including an aperture adapted to dispense fluids from a reservoir of the dispenser.

In an aspect combinable with any other aspect described herein, the reservoir is compressible.

In an aspect combinable with any other aspect described herein, in some implementations the reservoir may be formed between one or more sheets, films or webs of the container.

In an aspect combinable with any other aspect described herein, in some implementations, the reservoir may be formed between one or more sheets, laminate, films or webs separate from the container and placed therein.

In an aspect combinable with any other aspect described herein, a distal end of the applicator tip may include a natural or synthetic bristle brush.

In an aspect combinable with any other aspect described herein, fluid is transferred to the applicator tip via a conduit or passageway that channels the fluid from the reservoir to the brush, if one is present, when the reservoir is compressed.

In an aspect combinable with any other aspect described herein, the container is disposable after a number of uses.

In an aspect combinable with any other aspect described herein, in some implementations the applicator tip is reversibly foldable both toward the reservoir and away from the reservoir wherein a crimp or crease at a base portion of the applicator tip when in the folded position, inhibits the flow of reservoir contents.

In an aspect combinable with any other aspect described herein, in some implementations the applicator tip may be collapsible in an accordian fashion and may be extended from the container.

In an aspect combinable with any other aspect described herein, in some implementations, the applicator tip is accessed by folding away or peeling away a protective cover or flap.

In an aspect combinable with any other aspect described herein, in some implementations, a distal end of the applicator tip may have a convex shape, a planar shape, a beveled shape or a curved shape.

In an aspect combinable with any other aspect described herein, the viscosity of the contents held in the reservoir may vary and the contents may be dispensed from the aperture given any position of the dispenser, e.g., upward, downward and sideways.

In some implementations, the distal end of the applicator tip/aperture may be opened by a resealable closure such as a zip-type closure.

In some implementations, the distal end of the applicator tip/aperture may include a tear-away strip that serves as a seal and includes an exposed tab that is connected to a ribbon, wire or line that when pulled, produces an aperture that is capable of expelling contents of the package via the applicator tip. Similarly, a tab may be connected to a peel-away strip with an adhesive surface that when pulled away from the applicator tip, exposes an aperture suitable for expelling contents of the dispenser.

In an aspect combinable with any other aspect described herein, a foldable flap may be attached to a portion of an applicator tip; the flap which may include a light-tack adhesive may be folded down against the package body and reversibly secured in the folded state producing a temporary crease-seal for the applicator tip.

It should be understood that the features, objects and aspects of any one embodiment may be added to or combined with the features, objects or aspects of any other embodiment.

BRIEF DESCRIPTION OF THE DRAWING FIGURES

Figure 12:
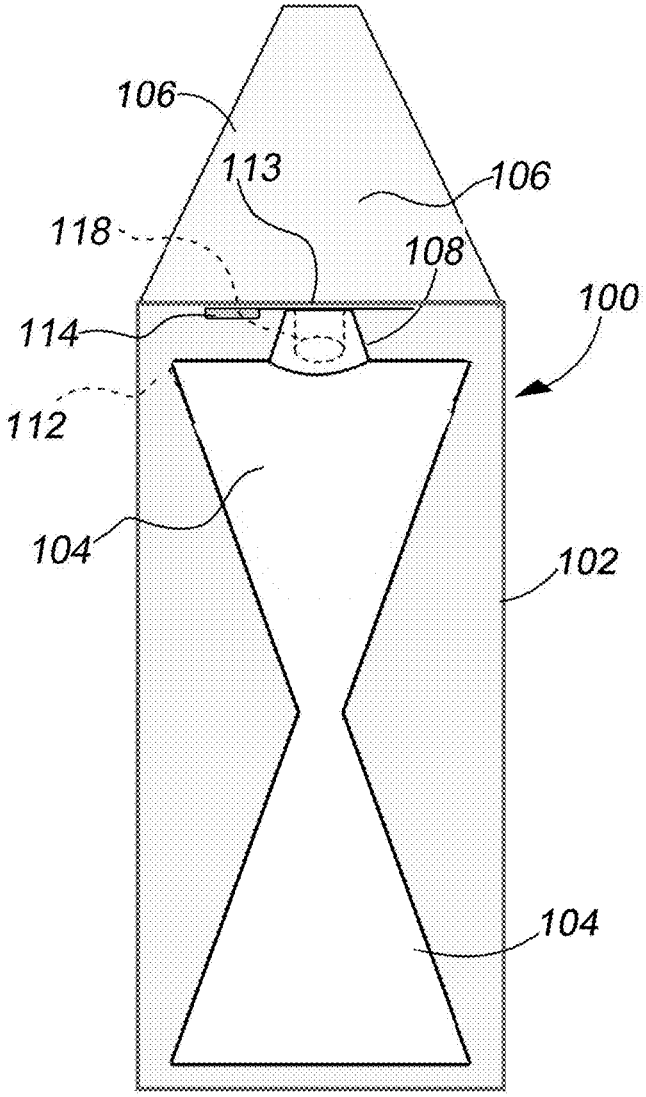
Figure 13:
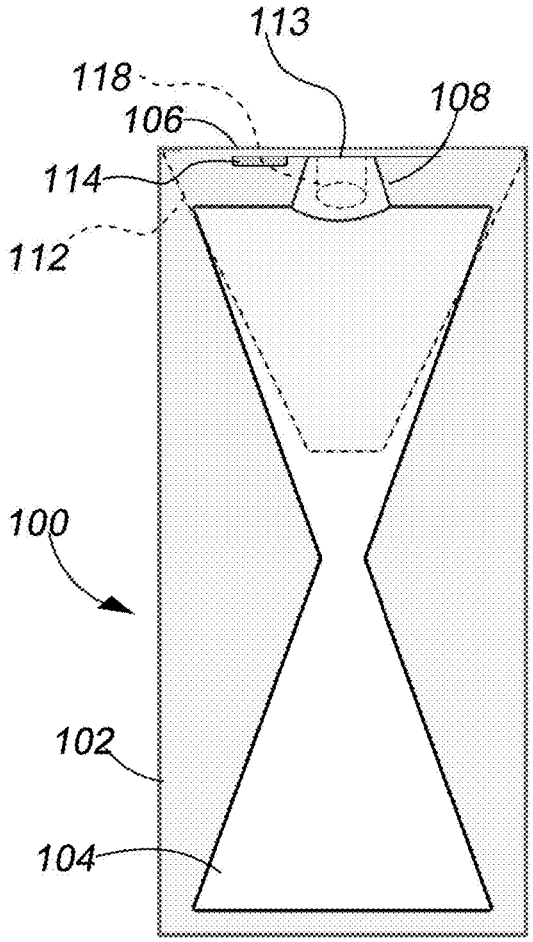
Figure 12A:
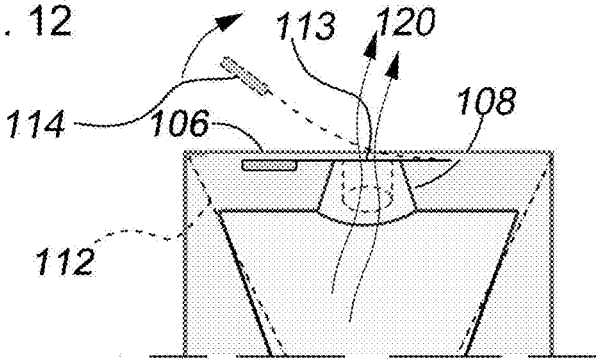
Figure 14:
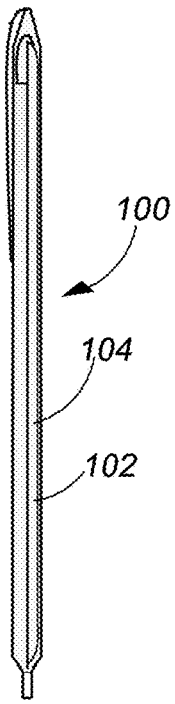
Figure 15:
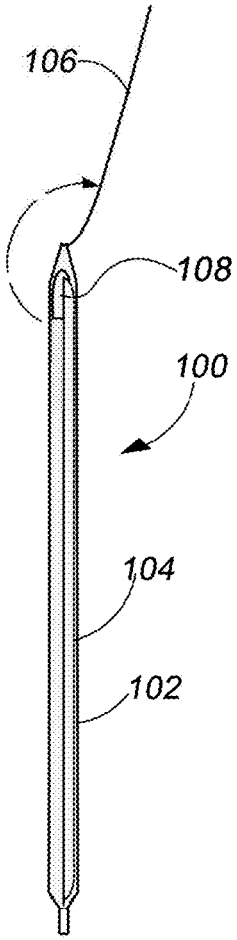
Figure 16:
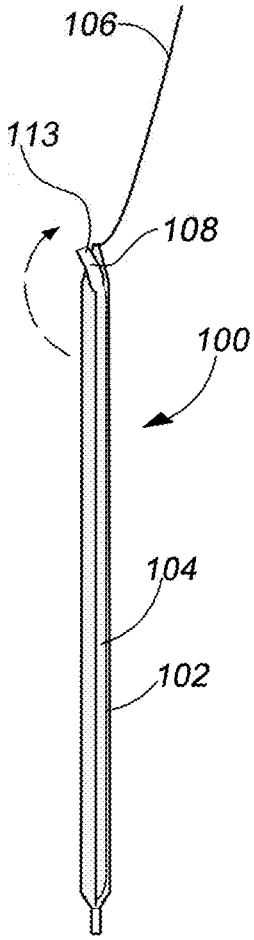
Figure 17:
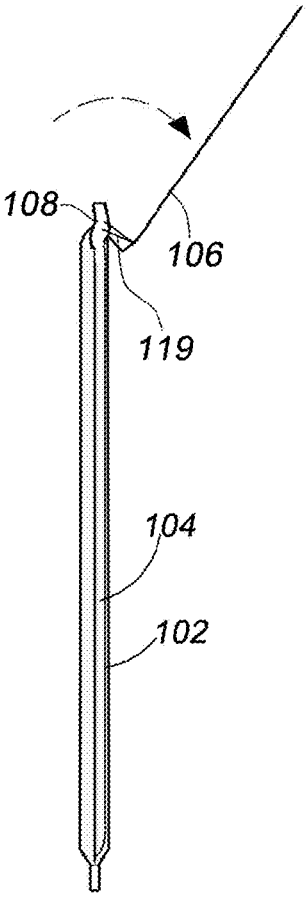
Figure 18:
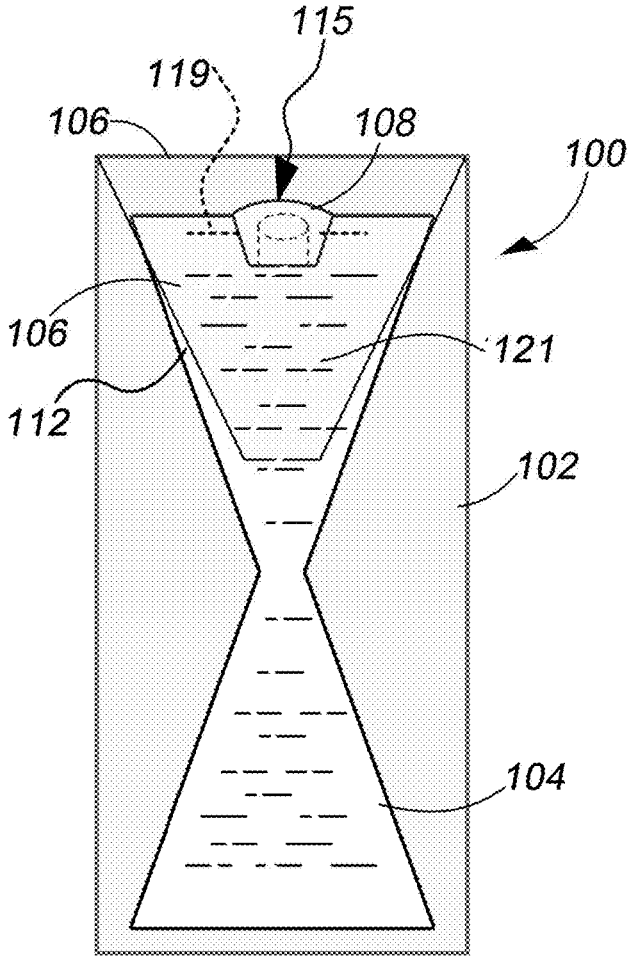
Figure 19:
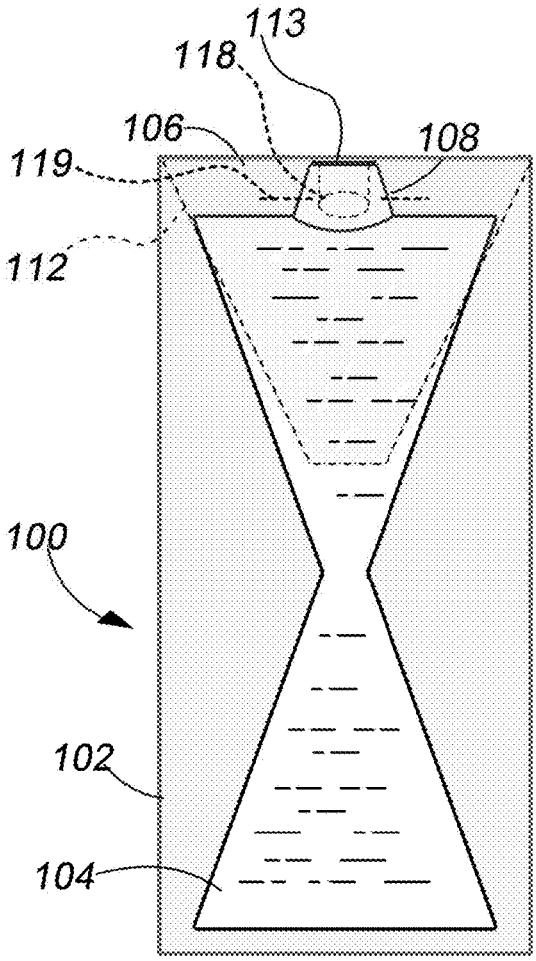
Figure 20:
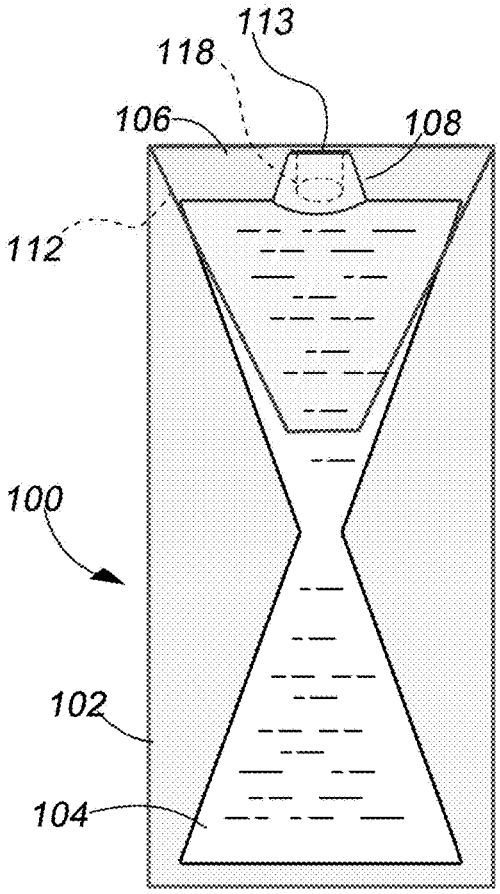
Figure 21:
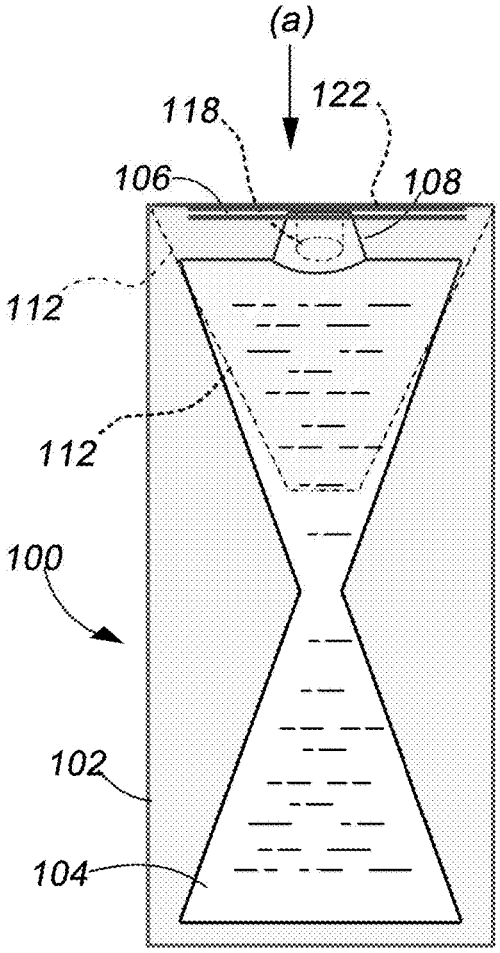
Figure 22:
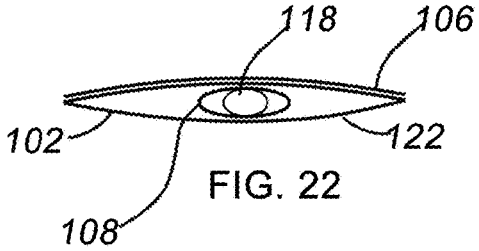

FIG. 12 in another implementation, is a front side view showing applicator tip in an upward pointing direction as formed originally in the printing web where with flap (106) is pulled back, the dashed line representing a break in a shared border with the flap and the outer surface of the container revealing the inner reservoir;

FIG. 12A is a partial view showing removal of a sealing strip (113) from the distal end of the applicator tip that can be broken between the top surface/film/sheet/laminate of the applicator tip and the back surface/film/sheet/laminate of the dispenser;

FIG. 13 is a front side view of the implementation showing flap (106) folded to the back side of the container;

FIG. 14 is a right side view of the applicator tip shown with flap closed;

FIG. 15 is a right side view shown with the flap folded away from the front of the applicator tip of the fluid dispenser;

FIG. 16 is a right side view shown with the applicator tip, shown enlarged for clarity, is manually foldable away from the interior compartment/fluid reservoir and assumes an extended ready to dispense position;

FIG. 17 in a side view of an implementation similar to that depicted in (FIGS. 8 and 9) shows a connector (119) connecting the flap (106) to a portion the applicator tip (108);

FIG. 18 is a front side elevation of the implementation of (FIG. 17) showing the fluid dispenser (100) in a closed position;

FIG. 19 is another side elevation thereof showing the dispenser in an open position where the flap has been moved to the back side of the fluid dispenser/article which effects the pivotably raising the applicator tip (108) away from the fluid reservoir to which it is connected via conduit (118);

FIGS. 20-21 are side elevations of another implementation that includes a resealable closure (122) shown in dashed line (FIG. 21) for the conduit portion other than or in addition to flap (106) which is shown folded to the back of the container in (FIG. 21);

FIG. 22 is an end view thereof taken in the direction of (FIG. 21) arrow (a) showing the resealable closure (122) opened revealing an open ended applicator tip (108).

REFERENCE TO THE NUMBERED ELEMENTS

100 fluid dispenser
102 exterior
104 fluid reservoir/compartment
106 flap
108 applicator tip/portion
109 bristles/foam
112 edge of flap
113 aperture
114 tab and strip
115 crease seal
118 conduit
119 connector linkage
120 fluid/makeup
122 sliding channel closure/zip-type closure/resealable closure

Definitions

In the following description, the term "fluid" typically refers to a fluid intended for application to a human body which may vary in viscosity from a liquid to a gel or paste. The term "lipstick" may mean a cosmetic, a balm, an antibiotic or any substance applicable to human lips. The term "reservoir" means any pouch, pocket or compartment adapted to hold a quantity of fluid. The term "conduit" refers to a physical feature, e.g., passageway, that conveys fluid contained in the reservoir to the applicator tip. The term "breakable" seal includes any one-time tear away strip or peel away strip, a resealable zip-type closure or any combination thereof, e.g., a peel away strip revealing a zip-type closure. The applicator tip may include a tubular member as a stiffening element at its distal end, bristles or permeable foam tip. Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references listed in this disclosure are incorporated by reference in their entirety for all purposes. In case of conflict, the present specification, including explanations of terms, will control. In addition, the materials, methods, and examples are illustrative only and not intended to be limiting.

DETAILED DESCRIPTION OF THE EMBODIMENTS

Referring generally to FIGS. 1-22, a fluid dispenser article (100) includes an exterior (102) a fluid reservoir (104) a foldable applicator tip (108), a movable flap (106) which covers the applicator tip (108), and a conduit (118) between the reservoir (104) and the applicator tip such that fluid may flow to the applicator tip when the reservoir is squeezed.

Mode of Operation

In order to use the fluid dispensing article (100), flap (106) is peeled away or folded away from the body of the article (100) providing access to the foldable applicator tip (108) which is connected to the reservoir (104) by conduit (118) which also is foldable and may reside wholly or partially inside the foldable applicator tip (108). In order to apply fluid contents, the applicator tip is folded away from the reservoir (104) such that it may extend from the fluid dispenser and assume a position ready to dispense fluid. Once the applicator tip is thus positioned, the reservoir (104) may be squeezed to push the fluid through the conduit (118) and to a distal end of the applicator tip (108). Note that in the folded position the conduit naturally assumes a kink or crease that prevents fluid flow. Flap (106) may be attached to the front exterior of the article/fluid dispenser by adhesive, living hinge or it may be otherwise formed integrally with the dispenser and separable via perforations forming a separation line (112) between the outer layer and the reservoir and the foldable applicator tip. The flap may be folded out of the way and moved back and forth assuming an open or closed position atop the applicator portion or the flap may be completely removable by tearing away via perforations. Furthermore in some implementations, the flap may be connected to the applicator tip (108) via a connector portion (119) such that when the flap is away from the front of the dispenser, it may actuate; e.g., apply tension to the applicator tip, urging the applicator tip to assume an upright ready-to-dispense position. Connector portion (119) may be formed of the same material as the body of the article, flap, or may be another type of material, e.g., adhesive, silicone rubber or other flexible material, applied or molded between the conduit (118) to the flap (106) and connecting them.

Figure 1:
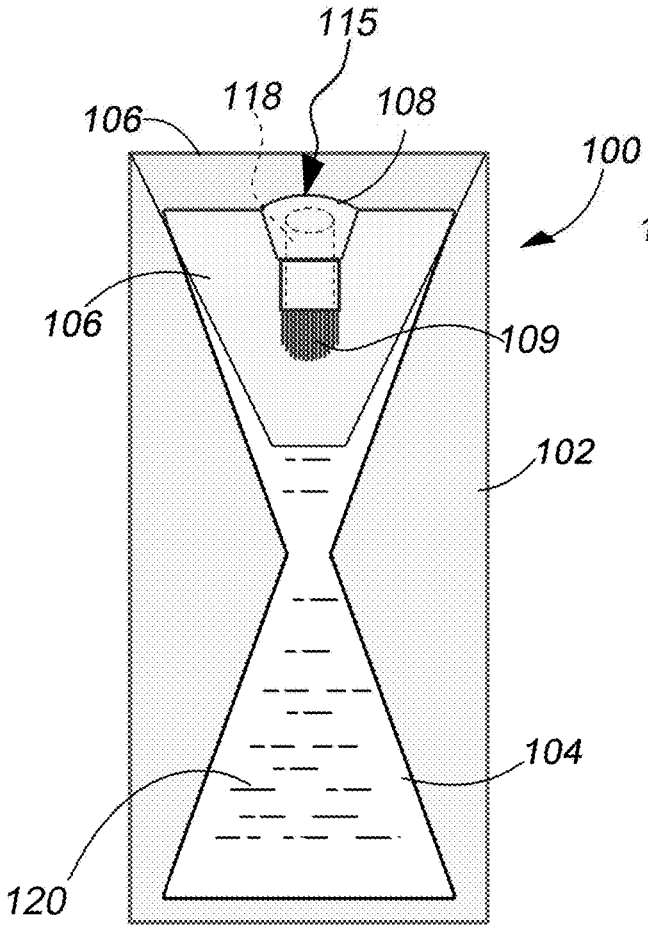
FIG. 1 shows a front view elevation of an implementation of a fluid dispenser.

FIG. 1 is a front view elevation of a fluid dispenser (100). It should be understood that the hour-glass shape of the fluid reservoir (104) is merely exemplary, and persons having ordinary skill in the art and access to this disclosure will appreciate that other shapes, e.g., oval, rectangular, triangular, circular, etc., may be suitable. Typically, the reservoir may be formed integrally with the exterior (102); for example, the dispenser may produced in a web wherein spaces around the reservoir are heat sealed front to back, and the applicator tip (108) and conduit (118) are sonically welded to the reservoir prior to filling of same. Persons having skill in the art and familiar with web laminated and print web processes will understand a variety of common manufacturing processes may be employed to produce the disclosed invention. Alternatively, the reservoir may be produced and filled in a first process and then in a second process laminated between a sandwich of material including exterior (102).

Figure 2:
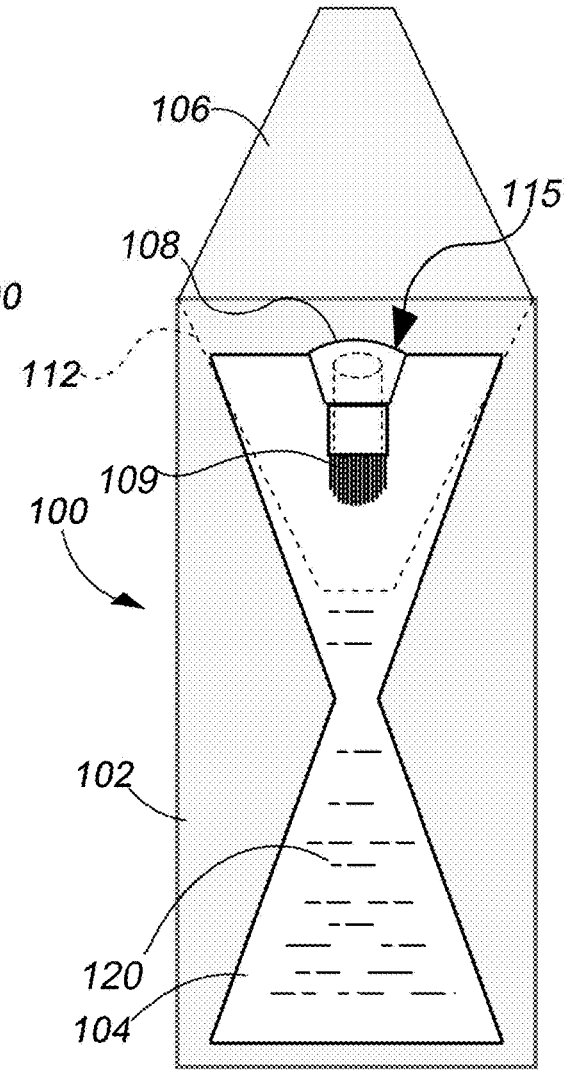
FIG. 2 is a front side view thereof showing flap folded away from the front of the dispenser.
Figure 3:
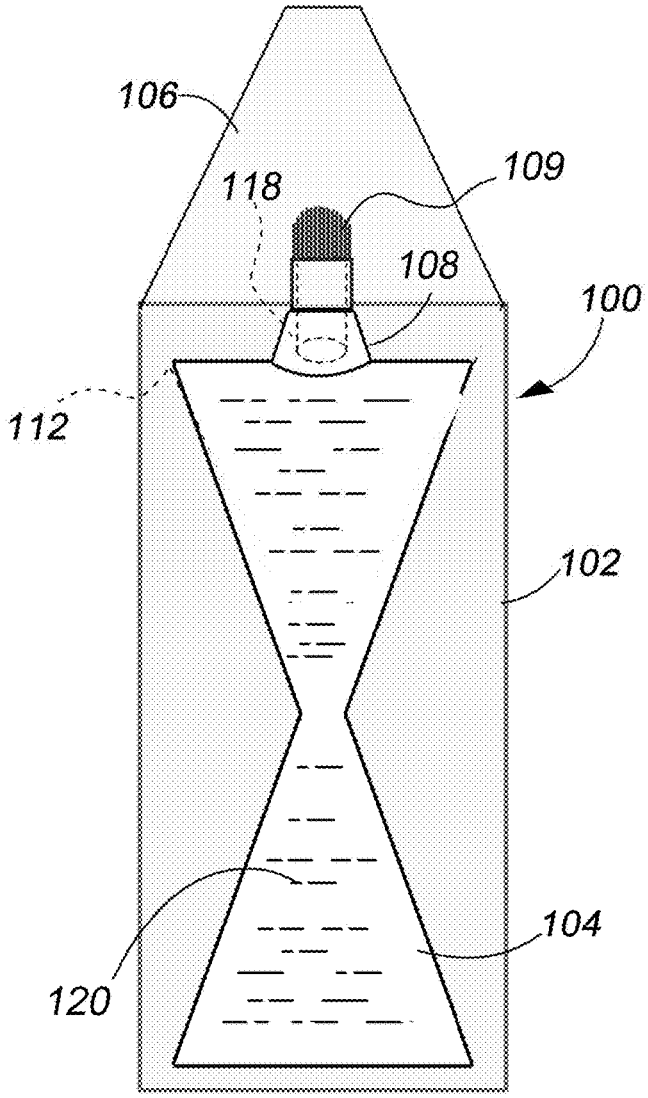
FIG. 3 is a front side view showing an applicator tip (108) folded away from the interior fluid reservoir (104)

FIG. 2 shows the dispenser (100) with flap (106) peeled away from the dispenser body exposing the applicator tip (108). In FIG. 3 applicator tip (108) is shown in an extended position. In the unextended position; e.g., where the brush is pointed down, there may be a natural fold line or kink in the conduit (118) that prevents passage of reservoir contents (120). Pointing the applicator tip upwardly may require manually flipping the tip or in some implementations, a connecting member between the applicator tip and flap (106) may "pull" the applicator tip into the extended position when the flap is moved from the front of the fluid dispenser to the back thereof. Conduit (118) may include an interior channel for fluids shown in dashed line that connects the brush tipped applicator or bare applicator tip to the fluid reservoir. Conduit (118) may be made of a flexible plastic such as LDPE, while the remainder of the dispenser may be made of laminated foil lined Mylar® or any one of a variety of suitable materials used to contain cosmetics and related fluids.

Figure 4:
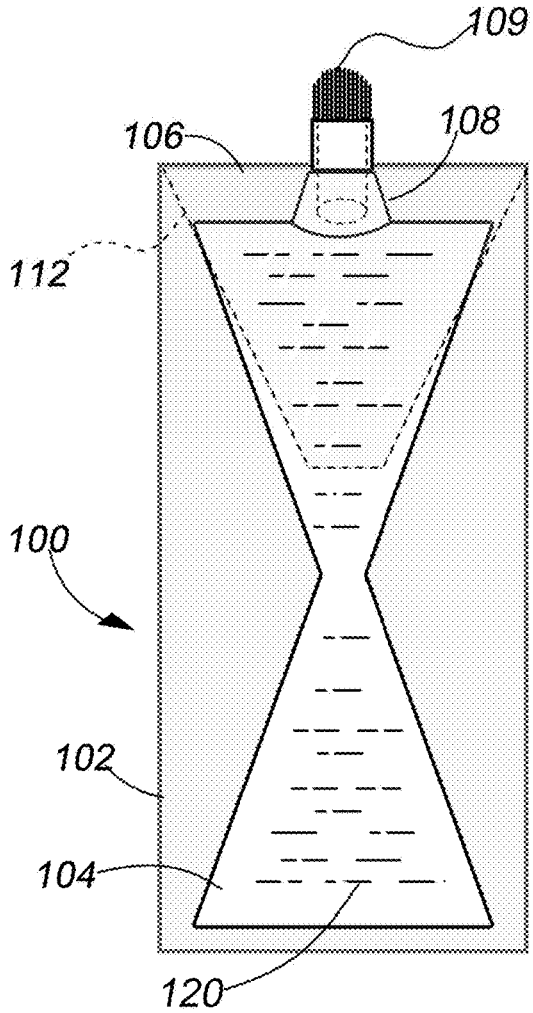
FIG. 4 is a front side view thereof showing flap folded away from the extended applicator tip.

FIG. 4 shows flap (106) moved to the back side of the dispenser (100) to assist in applying lipstick, gel or other solution.

Figure 5:
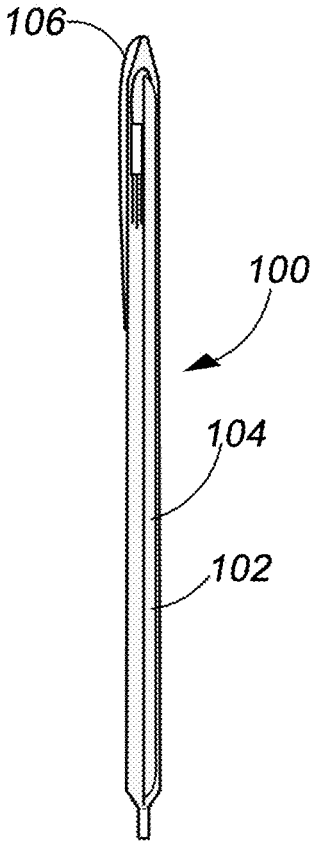
FIG. 5 is a right side view of the fluid dispenser of (FIGS. 1-4) shown with flap closed.
Figure 6:
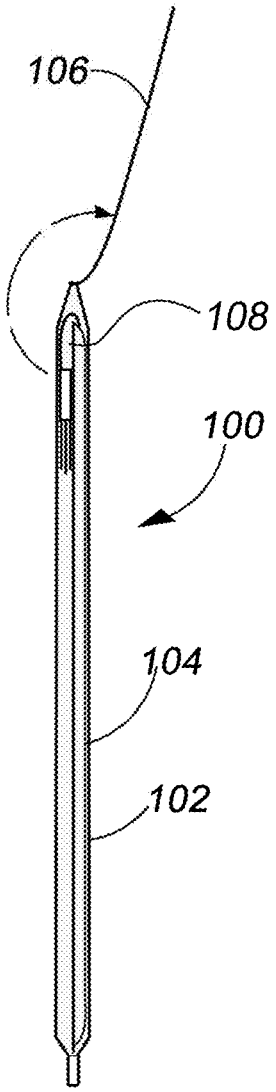
FIG. 6 is a right side view shown with the flap folded away from the front of the container.
Figure 7:
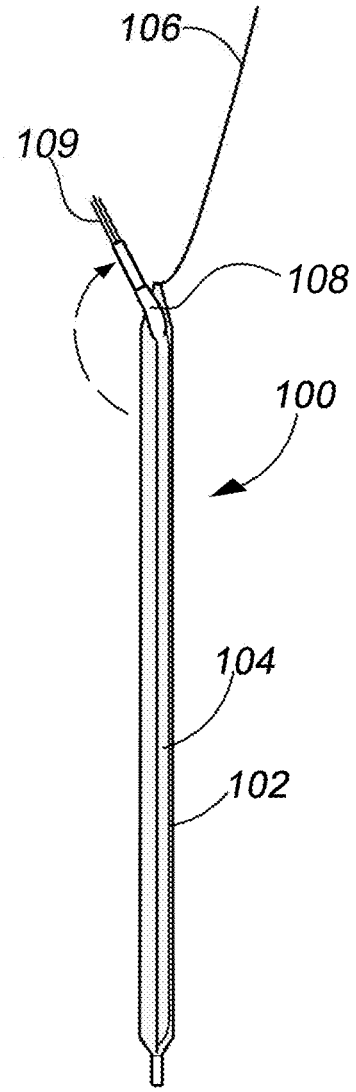
FIG. 7 is a right side view shown with the applicator tip folded away from the interior reservoir.

FIGS. 5-7 are sequential side views of the dispenser showing it in a closed position (FIG. 5), flap up position (FIG. 6) and applicator tip (108) extended (FIG. 7).

Figure 8:
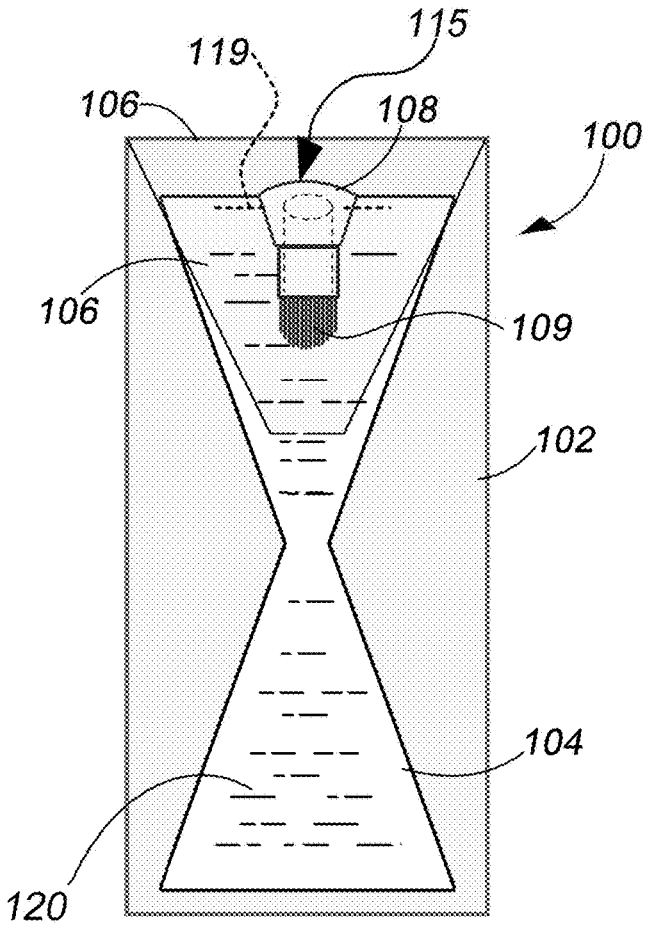
FIG. 8 is a front side elevation showing an applicator tip (108) in a folded closed position with flap (106) covering the applicator tip.
Figure 9:
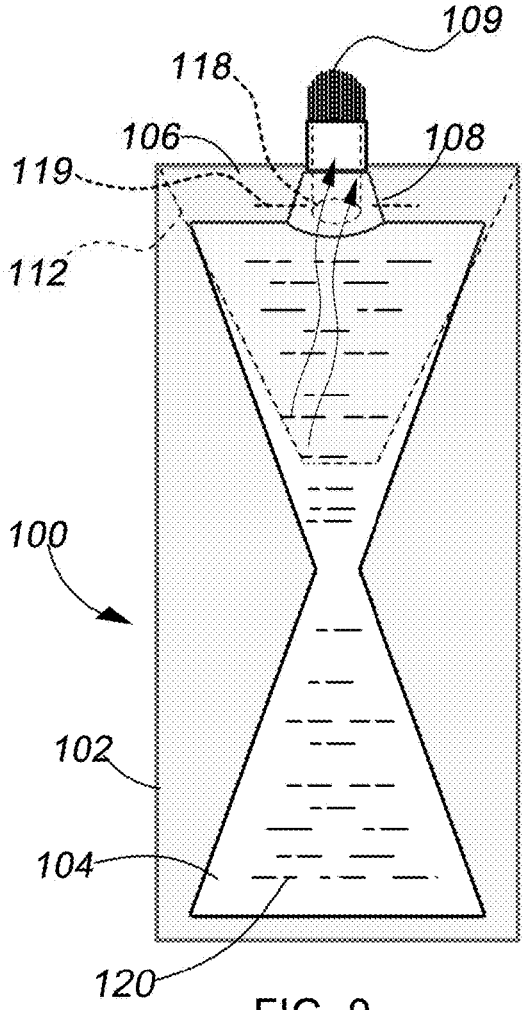
FIG. 9 is another front side elevation showing the applicator tip in an open position where the flap has been folded to the back side of the container.

FIGS. 8 and 9 respectively show the dispenser in a closed and open position wherein flap (106) is connected to the applicator tip (108) such that moving the flap back pulls the applicator into an upright position. This feature may be accomplished by a small material connector (119) such as a thin strip of LDPE, rubber band, or rubberized adhesive connected (119) to an upper section of the applicator portion (108), e.g., just below where the bristles or foam are joined to the applicator tip.

FIGS. 10-19 depict in similar views to that shown in (FIGS. 1-9), an implementation where a distal end of the bare applicator tip (108) is truncated and includes an aperture (113) connected to conduit (118) which forms a passageway for reservoir (104) contents. The length and width of the applicator tip can vary according to the viscosity of the solution to be applied and the particular application. Aperture (113) diameter may vary as required by the application, e.g., If the solution is a cyanoacrylate glue, the aperture diameter is likely to be less than if the solution is an antibiotic in a petroleum jelly based carrier.

Figure 10:
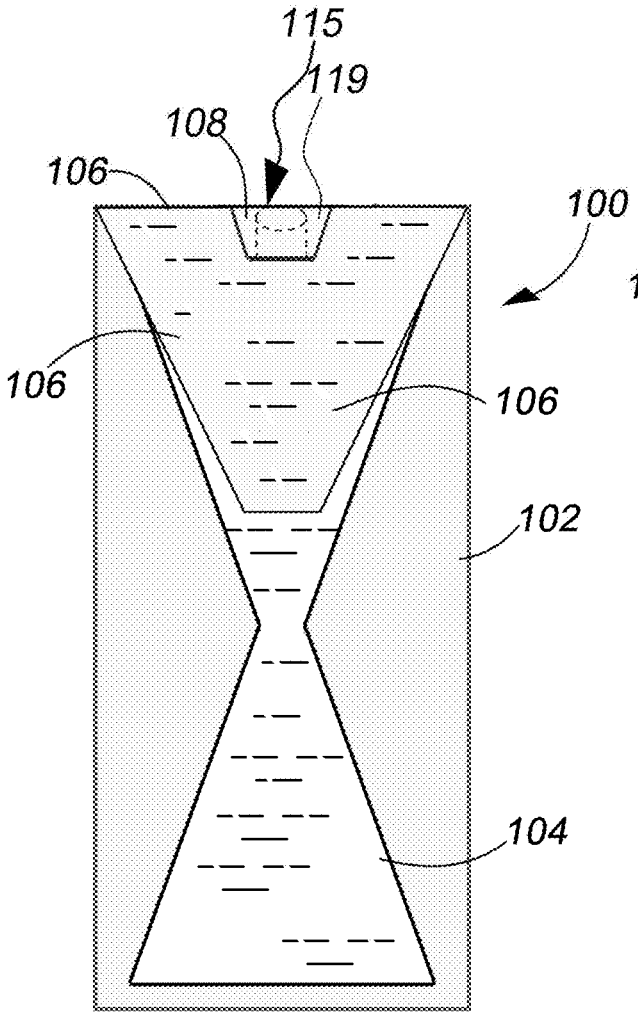
FIG. 10 shows a front view elevation of a second implementation of a container with an applicator tip (108) in a non-dispensing folded down position.
Figure 11:
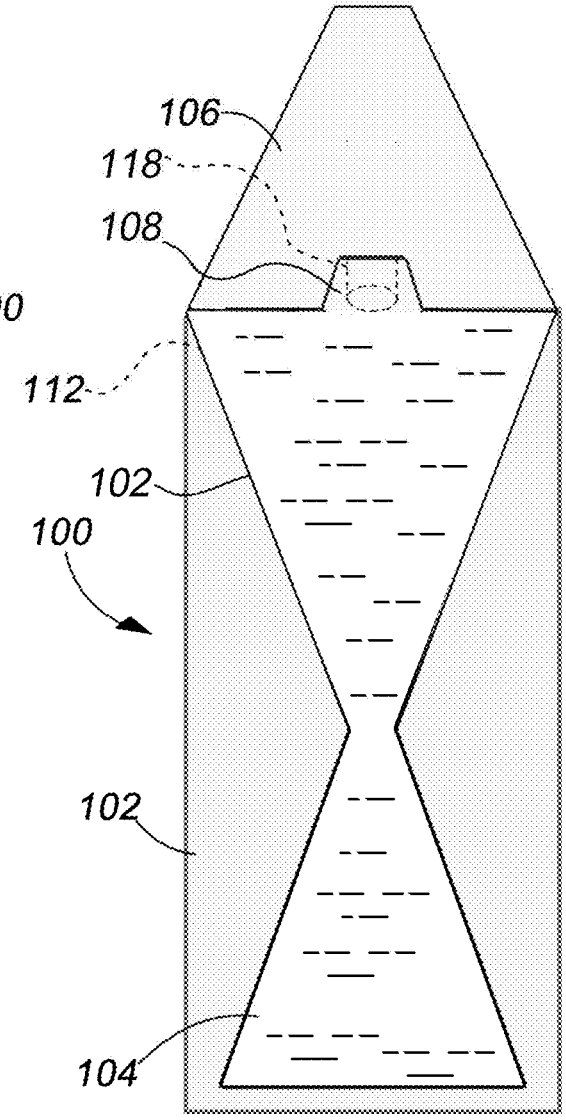
FIG. 11 is a front side view thereof showing flap (106) folded away from the front of the container and a portion of the applicator tip (108) is attached to the flap such that folding away the flap draws the applicator tip into an upright position.

More specifically, FIGS. 10 and 11 show a dispenser with an applicator tip (108) that has a portion of it joined to flap (106) via a connector linkage; e.g., (FIG. 17) (119) that may be a thin film strip, spot or strip of adhesive, web or bridge of LDPE or other suitable material joined to a back side portion of the applicator tip, typically at the base thereof, such that drawing the flap back raises the applicator tip from a folded creased position and creates a straight; i.e., not kinked or creased, conduit (118) for free flow of reservoir (104) contents.

FIG. 12 shows a dispenser with the flap (106) folded away from the front of the dispenser and FIG. 13 shows the flap folded around to the back side of the dispenser. FIG. 12A shows a removable tab connected to a strip (114) that when pulled away from the dispenser package, breaks a seal between a distal end of the applicator tip (108) and the backing film or laminate such that the contents (120) of the reservoir (104) may be expressed.

FIGS. 14-16 are side views of an implementation wherein the applicator tip may be manually raised into an upright position after withdrawing the flap.

FIG. 17 shows one possible configuration of a flap (106) connected to conduit (118) via a connector linkage (119) that may be a thin strip of film, spot of adhesive, web or bridge of LDPE or other suitable material joined to a portion of the applicator tip (108), e.g., just below the distal end of the applicator tip, such that the applicator tip is drawn back into an upright position by withdrawing or bending back the flap.

FIGS. 18 and 19 show respectively, front side elevations where flap (106) is in the front closed position over the applicator tip (108) and then shown fully folded to the back side of the dispenser, the borders of the flap shown in dashed line. In such implementations, connector linkage (119) may be attached to a back side portion of the applicator tip (108) typically at the base thereof such that when the flap is moved from the front closed position to the back of the dispenser, it pivots, i.e., pulls, the applicator tip into an upright position. In FIG. 19, while the aperture (113) of the upright applicator tip (108) the dimensions of which are exaggerated for illustrative purposes, is shown at the same level as the top edge of the dispenser body, it may extend beyond, e.g., (FIG. 17) as determined by the dispenser contents and desired application.

FIGS. 20 and 21 show respectively, flap (106) in a closed and open (folded to back position). However, in both positions applicator tip (108) is maintained in the upright position. In such implementations, in lieu of a kink or crease (115) in the conduit (118) that is relieved by straightening the applicator tip (108) either by manipulating it with the fingers or by action of linked (119) folding flap (106) from the front to the back of the dispenser, here, aperture (113) may be further "sealed" by a resealable closure (122) such as a zip-type closure which is accessible and manipulable when the flap is opened. In similar implementations the flap may be omitted entirely and a sliding channel closure/resealable closure (122) may be formed at the topmost edge of the dispenser. Such resealable closure may include a zip-type closure (122) or a tear-away or peel-away type closure (FIGS. 12, 13) that when unsealed, allows the contents (104) to be expelled.

FIG. 22 is a diagrammatic view of the dispenser of (FIG. 21) taken in the direction of arrow (a) (FIG. 21) where the applicator tip aperture (113) is accessed or sealed by a tearing away or peeling away a seal or sliding a resealable zip-type closure (122).

It should be understood that the drawings and detailed description herein are to be regarded in an illustrative rather than a restrictive manner, and are not intended to be limiting to the particular forms and examples disclosed. For example, while in the implementations described herein, the inner reservoir is an hourglass shape, within the invention, other shapes may be used. In addition to cosmetics application, various implementations described herein may be suitable for the dispensing of medicaments, paints, inks and other solutions. Accordingly, it is intended that this disclosure encompass any further modifications, changes, rearrangements, substitutions, alternatives, design choices, and embodiments as would be appreciated by those of ordinary skill in the art having benefit of this disclosure, and falling within the spirit and scope of the following claims.

I claim:

1. A dispenser article for a cosmetic solution comprising:

an exterior with a front side, a back side and a compressible interior reservoir between the front and back side adapted to contain a cosmetic product and wherein the front side and back side are compressible and the reservoir is connected to an applicator portion via a conduit;

the applicator portion includes a dispensing end with a breakable seal including a tear-away strip at one end of the dispensing end;

a movable flap at least movable from a first position at the front side of the article atop a broken seal of the dispensing end to a second position at the back side of the article; and, the front side and back side including one or more of the following: flexible sheets, films or webs.

2. The dispenser article according to claim 1, the applicator portion connected to the movable flap.

3. The dispenser article according to claim 1, the application portion capable of altering position via the movable flap.

* * * * *